United States Patent [19]

Miller

[11] Patent Number: 4,497,581

[45] Date of Patent: Feb. 5, 1985

[54] PAINT SHAKER

[75] Inventor: Herbert L. Miller, Roselle, Ill.

[73] Assignee: Miller Paint Equipment, Inc., Addison, Ill.

[21] Appl. No.: 94,634

[22] Filed: Nov. 15, 1979

[51] Int. Cl.[3] ..... B01F 9/00

[52] U.S. Cl. ..... 366/208; 366/232; 366/605

[58] Field of Search ..... 366/208-217, 366/220, 232, 605, 55

[56] References Cited

U.S. PATENT DOCUMENTS

| | | | |
|---|---|---|---|
| 1,332,019 | 2/1920 | Allison | 366/214 |
| 3,503,592 | 3/1970 | Taylor, Sr. et al. | 366/212 |
| 3,880,408 | 4/1975 | Karjalainen | 366/217 |
| 3,885,357 | 5/1975 | Hoyt . | |
| 4,146,335 | 3/1979 | Hutchings et al. | 366/217 |
| 4,235,553 | 11/1980 | Gall | 366/208 |

FOREIGN PATENT DOCUMENTS

| | | | |
|---|---|---|---|
| 1387402 | 3/1975 | United Kingdom | 366/217 |

*Primary Examiner*—Timothy F. Simone
*Attorney, Agent, or Firm*—Mason, Kolehmainen, Rathburn & Wyss

[57] ABSTRACT

A paint shaker for agitating and mixing paint and the like, and/or flowable materials in a container comprises a bucket having an open upper end for receiving the container and mounted to rotate around an upwardly sloping axis. A yoke is provided for supporting the bucket and the yoke is mounted to rotate around a separate, vertical axis intersecting the axis of the bucket at a crossover point. A motor is provided for simultaneously driving the bucket and the yoke to spin about their respective axes to rapidly mix and agitate the material in the container placed in the bucket. The bucket includes a bottom wall for supporting the container with the center of gravity of the container and its contents being continually spaced below the crossover point of the axes so that the paint container does not tend to rise and climb out of the bucket during the mixing process and thus a clamp or top is not required for retaining the container in place while mixing.

19 Claims, 6 Drawing Figures

FIG. 4
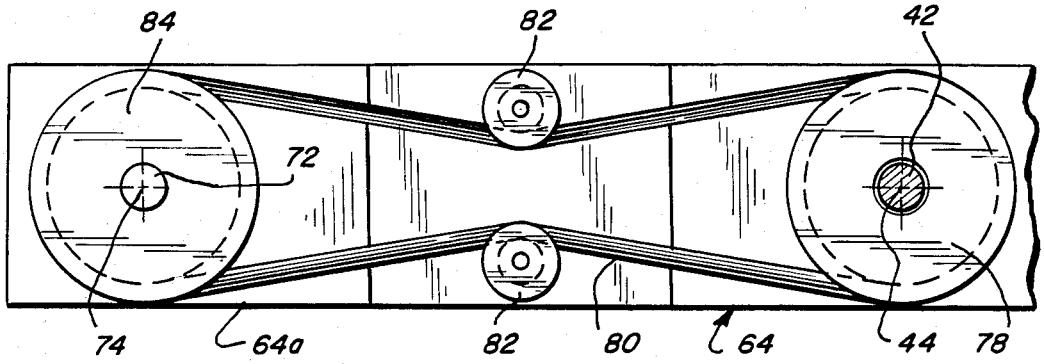
FIG. 5
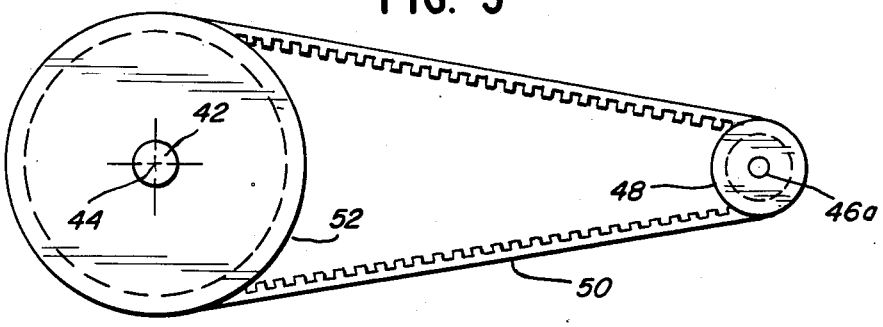
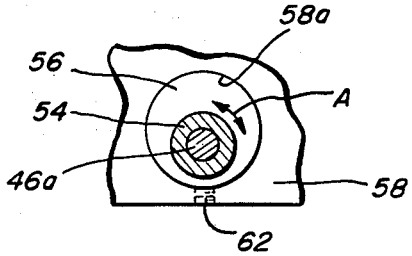
FIG. 6

PAINT SHAKER

BACKGROUND OF THE INVENTION

1. Field of the Invention

The present invention relates to apparatus for mixing and agitating flowable material such as paint and the like in closed containers. More particularly, the present invention relates to paint shakers and the like which are capable of rapidly and efficiently mixing and agitating without requiring removal of the materials from their original containers and without requiring the containers to be clamped or otherwise mechanically secured in place in the mixing or agitating apparatus.

Many flowable or fluidized materials such as paints, powdered materials, fungible particulates and the like, both in cans or other containers contain liquids of differing specific gravities as well as solids and/or powdered materials dispersed thereon. In many instances, the different constituents of the mixture require a thorough mixing and blending before the mixture is suitable for use in order to insure an even dispersion of the various constituents throughout the whole mixture. This is particularly important with paints, varnishes and other finishing agents wherein pigments are often solids and are usually much denser than some of the other liquid constituents. Oftentimes, after only a short time in a container on a shelf, the denser or heavier materials gravitate out from the lighter constituents and collect on the bottom of the can or container. Subsequently, when a can is opened, the material must be tediously mixed and agitated, often for extended periods of time before it is suitable for use. Even during the application process, the heavier materials in some mixtures may settle out and accordingly, periodic intermixing and agitation during use or application is required.

It is often very important to be able to achieve a thorough and efficient mixing job in an extremely short period of time and without requiring other than minimal skills on the part of the person(s) operating the mixing apparatus. This is especially true at establishments such as retail paint stores or departments and the like, wherein minimal staffing for high volume traffic is often the norm rather than an unusual situation, and accordingly, where mixing time is of the essence.

2. Brief Description of the Prior Art

A wide variety of paint shakers and mixer/agitators have been developed over the years, along with a wide variety of mixing, agitating, and washing machines of various types. U.S. Pat. Nos. 79,872; 1,755,763; 3,229,964; 3,542,344; 3,706,443; 3,880,408; 4,125,335 and 4,134,689 disclose, illustrate and describe many prior art endeavors in the area of mixing, agitating, washing and blending of flowable materials. In addition, German patent No. 1,080,072 and Dutch patent application No. 7502372 disclose mixing apparatus wherein a container of material to be mixed or agitated is rotated about a pair of separate axes of rotation simultaneously to achieve a rapid mixing action desired.

OBJECTS OF THE PRESENT INVENTION

It is an object of the present invention to provide a new and improved paint shaker for agitating and mixing flowable materials and the like.

More particularly, it is an object of the invention to provide a new and improved paint mixer for rapidly and efficiently mixing flowable materials without requiring the removal of the material from the container.

Another object of the present invention is to provide a new and improved mixing apparatus of the character described which does not require that the container of material be clamped or otherwise mechanically attached to the mixing apparatus.

Yet another object of the present invention is to provide a new and improved paint shaker having an open ended receiving bucket adapted to accommodate a container or can of paint or other material to be mixed in a manner whereby there is no tendency for the container to be thrown or ejected from the apparatus during the mixing processes.

Yet another object of the present invention is to provide a new and improved paint shaker of the character described including an open ended bucket especially adapted for top loading of a container of material to be mixed.

Another object of the present invention is to provide a new and improved paint shaker apparatus which does not require clamping means or other mechanical devices to be utilized to secure the container in place during the mixing or shaking process.

Still another object of the present invention is to provide a new and improved paint shaker that is especially well suited for use in retail establishments and especially well adapted for operation by relatively unskilled persons.

Another object of the present invention is to provide a new and improved paint shaker of the character described which can readily accommodate several different sizes of containers.

Still another object of the present invention is to provide a new and improved paint shaker of the character described wherein the container of material is subjected to rapid rotation or spinning simultaneously on a pair of transversely intersecting axes of rotation.

Still another object of the present invention is to provide a new and improved paint shaker/mixer of the character described which provides for a more complete and uniform dispersion of the constituents throughout the mixture in a minimum amount of time.

SUMMARY OF THE INVENTION

The foregoing and other objects and advantages of the present invention are accomplished in an illustrated embodiment thereof comprising a paint shaker adapted for agitating and mixing flowable materials such as paint and the like in a container such as a closed can, pail or bucket. The apparatus includes a receiving bucket with an open upper end for receiving the container of material and the bucket is supported for spinning movement about an upwardly sloping spin axis. The bucket is mounted on a yoke which in turn is mounted for spinning movement about a spin axis that is angularly divergent from or transverse to the spin axis of the bucket and intersects the same at a crossover point. A motor and drive mechanism is provided for rotating the bucket and the yoke to simultaneously spin or turn about their respective spin axes. The bucket includes a bottom wall for supporting a container of paint or the like in a spinning position with the center of gravity of the container and is contents continuously spaced below the crossover point between the respective transversely intersecting spin axes of the bucket and yoke.

BRIEF DESCRIPTION OF THE DRAWINGS

For a better understanding of the invention, reference should be had to the following detailed description taken in conjunction with the drawings, in which:

FIG. 4 is a fragmentary, cross-sectional view taken substantially along lines 4—4 of FIG. 1, and illustrating a drive system of the paint shaker in accordance with the features of the present invention;

FIG. 5 is a fragmentary, cross-sectional view taken substantially along lines 5—5 of FIG. 1; and FIG. 6 is a fragmentary, cross-sectional view taken substantially along lines 6—6 of FIG. 1.

DESCRIPTION OF THE PREFERRED EMBODIMENT

Figure 1:
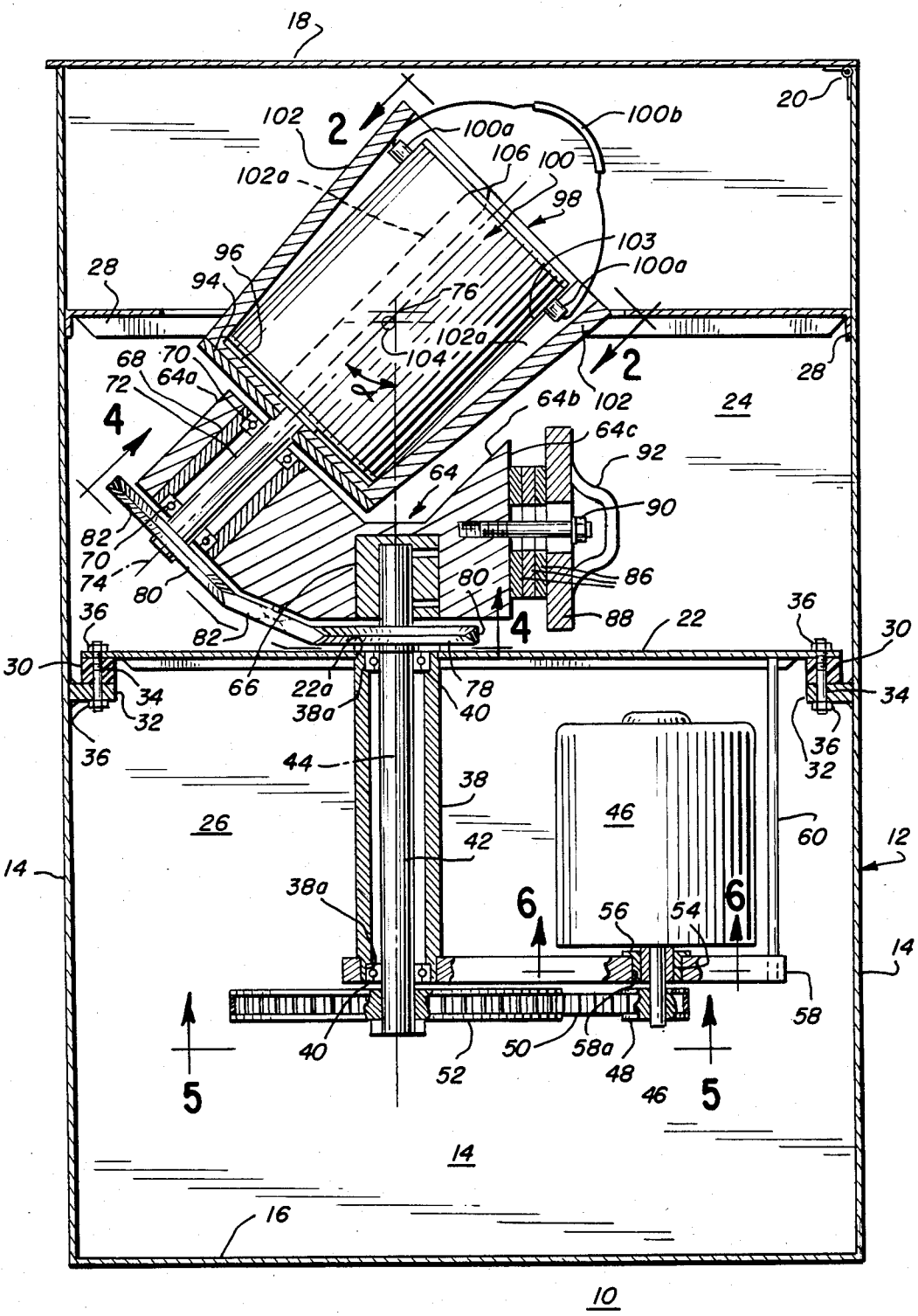
FIG. 1 is a vertical, cross-sectional view taken substantially along the center of a new and improved paint shaker constructed in accordance with the features of the present invention.

Referring now more particularly to the drawings, therein is illustrated a new and improved paint shaker/-mixer apparatus constructed in accordance with the features of the present invention and referred to generally by the reference numeral 10 in FIG. 1. The paint shaker 10 includes a cabinet 12 having upstanding side walls 14, a bottom wall 16, and a top 18 hingedly supported from one of the sidewalls 14 by one or more hinges 20 so that the top may pivot upwardly between a closed position as shown and an open position wherein the top of the cabinet is open for loading and unloading.

The cabinet 12 is provided with an intermediate horizontal wall or false bottom 22 which divides the cabinet into an upper working chamber 24 and a lower power chamber 26. The upper chamber is provided with inside wall stiffeners 28 of angle iron to minimize noise and vibration. The wall 22 is supported on a plurality of doughnut-shaped shock mounts 30 which are formed of resilient material to minimize the transmission of noise and vibration to the sidewalls 14 of the cabinet. The shock mounts 30 are supported on internal horizontal ribs 32 attached on the inside surface of the sidewalls 14. Elongated mounting pins or bolts 34 with nuts 36 at opposite ends are utilized for securing the intermediate wall 22 in place on the shock mounts supported by the wall ribs 32.

The bottom wall 22 of the upper chamber 24 provides support for a downwardly depending, hollow tubular bearing sleeve 38 which is secured at its upper end around the edges of a circular aperture **22*a* formed in the bottom wall in the central portion thereof. At opposite ends, the bearing sleeve is formed with a pair of annular shouldered recesses 38*a* in which are mounted ball bearing rings 40 for supporting a drive shaft 42 driven to rotate about a vertically disposed spin axis 44. Motive power is supplied for rotating the shaft 42 by an electric motor 46 having a downwardly depending, vertical rotor shaft 46*a* on which is mounted a toothed, drive sprocket 48 for driving a toothed, endless, timing belt 50 entrained around a larger diameter sheave or pulley 52 mounted on the lower end portion of the main drive shaft 42**.

The rotor shaft **46*a* of the motor is mounted in an annular, bearing sleeve 54 seated in an eccentrically positioned aperture formed ih a circular-shaped, mounting block 56 having an upper flange and seated in an aperture 58*a* provided in a motor support arm 58. As shown in FIG. 1, one end of the motor support arm 58 is attached to the lower end of the shaft sleeve 38 and an opposite, outer end is supported by a rod 60 extending upwardly from the arm and attached to the bottom wall 22 of the upper chamber 24. Tensioning of the belt 50 is achieved by relative rotation of the eccentric mounting block 56 in the aperture 58*a* as indicated by an arrow "A" and a radial set screw 62 (FIG. 6**) is provided for securing the mounting block in a selected position once the proper belt tension has been attained.

In accordance with the present invention, the shaft 42 extends upwardly above the level of the bottom wall 22 of the upper chamber 24 and supports a yoke 64 comprising a pair of opposite, laterally and outwardly extending, upsloping arms **64*a* and 64*b*. A central portion of the yoke is formed with a recess to accommodate a bushing 66 supported on the upper end portion of the shaft 42 and secured thereto so that the yoke will spin whenever the shaft is rotated. A hollow, tubular, bearing sleeve 68 is mounted in a cylindrical bore provided in the yoke arms 64*a* adjacent an outer end portion and the sleeve is formed with internal annular shoulders or recesses at opposite ends to accommodate a pair of ball bearing rings 70 for supporting a bucket spindle 72 mounted for rotation about an inclined spin axis 74**.

The sloping spin axis 74 intersects the vertical spin axis 44 of the yoke 64 at an elevated crossover point 76 above the yoke (as shown in FIG. 1) and the respective spin axes 44 and 74 lie on a vertical plane and intersect one another at an acute angle $\alpha$. The sloped spin axis 74 diverges downwardly and outwardly away from the crossover point 76 at the acute angle $\alpha$ towards the arm segment **64*a*** of the rotating yoke.

The bucket spindle 72 is driven to rotate whenever the yoke 64 is rotated by means of a fixed pulley 78 secured to the bottom wall 22 of the upper mixing chamber 24. The fixed pulley is provided with a central aperture to accommodate the upwardly extending main drive shaft 42 without interference therewith and is drivingly engaged with an endless V-belt 80. The runs of the belt pass between a pair of spaced apart, idler pulleys 82 mounted on the underside of the yoke arm **64*a* outwardly of the spin axis 44. The idler pulleys guide, twist and bend the belt runs so that an outer looped end will drivingly engage and track around a spindle drive pulley 84 mounted on a lower end portion of the bucket spindle 72 which extends downwardly from the underside of the yoke arm 64*a***.

Whenever the main drive shaft 42 rotates the yoke 64 about the vertical spin axis 44, the endless V-belt 80 entrained around the fixed pulley 78 and bucket drive pulley 84 causes the bucket spindle 72 to rotate about the sloping spin axis 74. As indicated on FIGS. 4 and 5, the motor drive pulley 48 is smaller in diameter than the main shaft drive pulley 52 in order to effect a reduction in speed so that the drive shaft 42 rotates in a speed range of 300 to 450 RPM. The fixed pulley 78 and bucket drive pulley 84, however, are preferably of the same diameter so that the bucket drive spindle 72 rotates at substantially the same speed as the yoke 64.

The opposite and somewhat shorter arm **64*b* of the yoke includes a vertical outer face 64*c* in order to accommodate a plurality of vertically movable shim plates 86 having elongated vertical slots in the central portion and adapted to serve as a counterweight for balancing the yoke. In addition to these weights, an outermost and larger counterweight element 88 is provided to secure the one or more smaller intermediate counterweights between an inner face and the vertical face 64***c* of the yoke. The outer counterweight 88 is also formed with an elongated vertical slot in order to accommodate the shank of a threaded cap screw 90 which is used for securing the counter weight in place on the arm 64*b*. The counterweight 88 may also be provided with a handle 92 so that an operator may conveniently grasp the yoke 64 to rotate the yoke into a desired position for loading and unloading from the top of the cabinet 12. The counterweights 86 and 88 may be mounted at selected levels on the vertical face 64*c* of the yoke 64 in order to provide the best center of gravity for balancing and minimizing the unbalanced forces and vibrations resulting from rotation of the yoke and components carried thereby.

Figure 2:
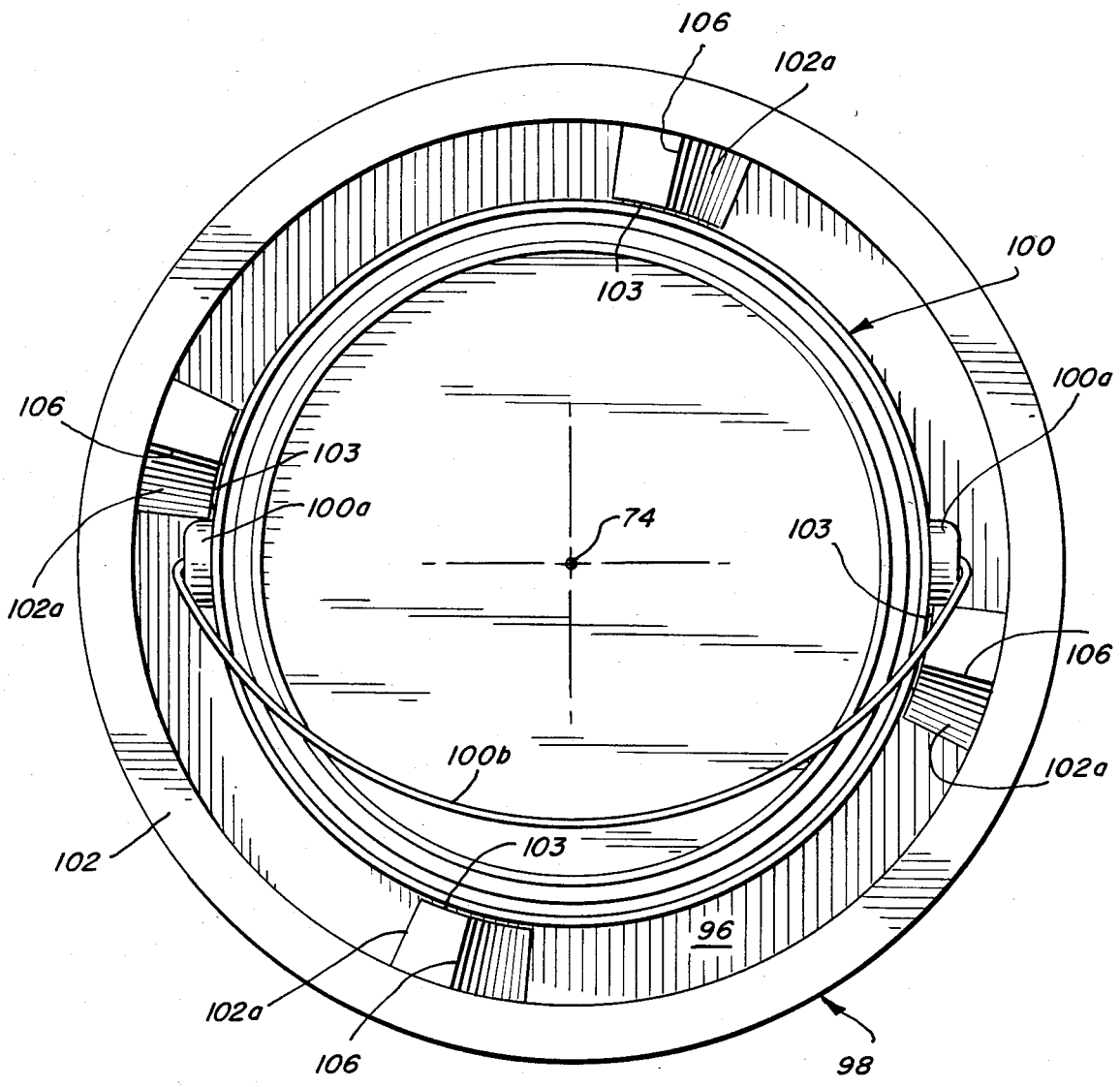
FIG. 2 is a fragmentary, sectional view looking in the direction of arrows 2—2 of FIG. 1.

In accordance with the present invention, on the upper end portion of the bucket spindle 72 there is provided a circular base plate 94 secured onto a shouldered end portion of the spindle and adapted to support the bottom wall 96 of an open ended bucket 98. The bucket is open at the top and is adapted to hold a paint can or other container 100 having material therein that is to be mixed and agitated in the apparatus 10. The bucket 98 includes an ingegral, upstanding, generally frustoconically-shaped sidewall 102 having a plurality of longitudinally extending drive and spacer ribs 102*a* integrally formed on the inside surface thereof. As illustrated in FIG. 2, the ribs 102*a* are formed with an inwardly facing cylindrical surface segment 103 that is spaced from the spin axis 74 of the bucket by a radial distance slightly greater than the radius of the paint cans 100 or the like that are to be held in the bucket.

The bucket is dimensioned so that a container placed in the bucket and seated against the bottom wall 96, provides for a center of gravity 104 of the container and contents that is spaced downwardly from and offset to one side of the crossover point 76 and preferably between the intersecting spin axes 44 and 74, respectively. Because of this arrangement, the paint can 100 or other container does not tend to rise or climb out of the bucket 98 when the drive yoke 64 and bucket are rotated about their respective axes 44 and 74 to mix and agitate the contents in the can. No clamping or other hold down means is required to retain the cans 100 in place in the bucket 98 and during rotation of the yoke and the bucket, the containers tend to seat even more firmly against the bottom wall 96 of the bucket because of the component forces caused by the spinning action which interacts between the sides of the can and the ribs 102*a* on the bucket sidewall 102 and the bottom wall 96.

The upper ends of the drive ribs 102*a* of the bucket are sharply pointed as at 106 to facilitate loading of the cans and when a can is lowered into the bucket, the handle supporting ears 100*a* on opposite sides of the can are guided by the pointed upper edges 106 to one side or the other of the ribs 102*a*. As illustrated in FIG. 2, when the bucket 98 is rotated, the side edges of the ribs 102*a* engage the ears 100*a* on the paint can to drive the can to rotate with the bucket.

Mixing and agitation of the material in a can placed in the bucket is rapid and efficient because the material is subject to intense shear caused by the whirling action simultaneously about a pair of angularly divergent, intersecting spin axes. The amount of mixing time required is substantially reduced below that required by other types of paint shaker/agitators and no clamps or lids are required to hold the cans in place in the bucekt.

Figure 3:
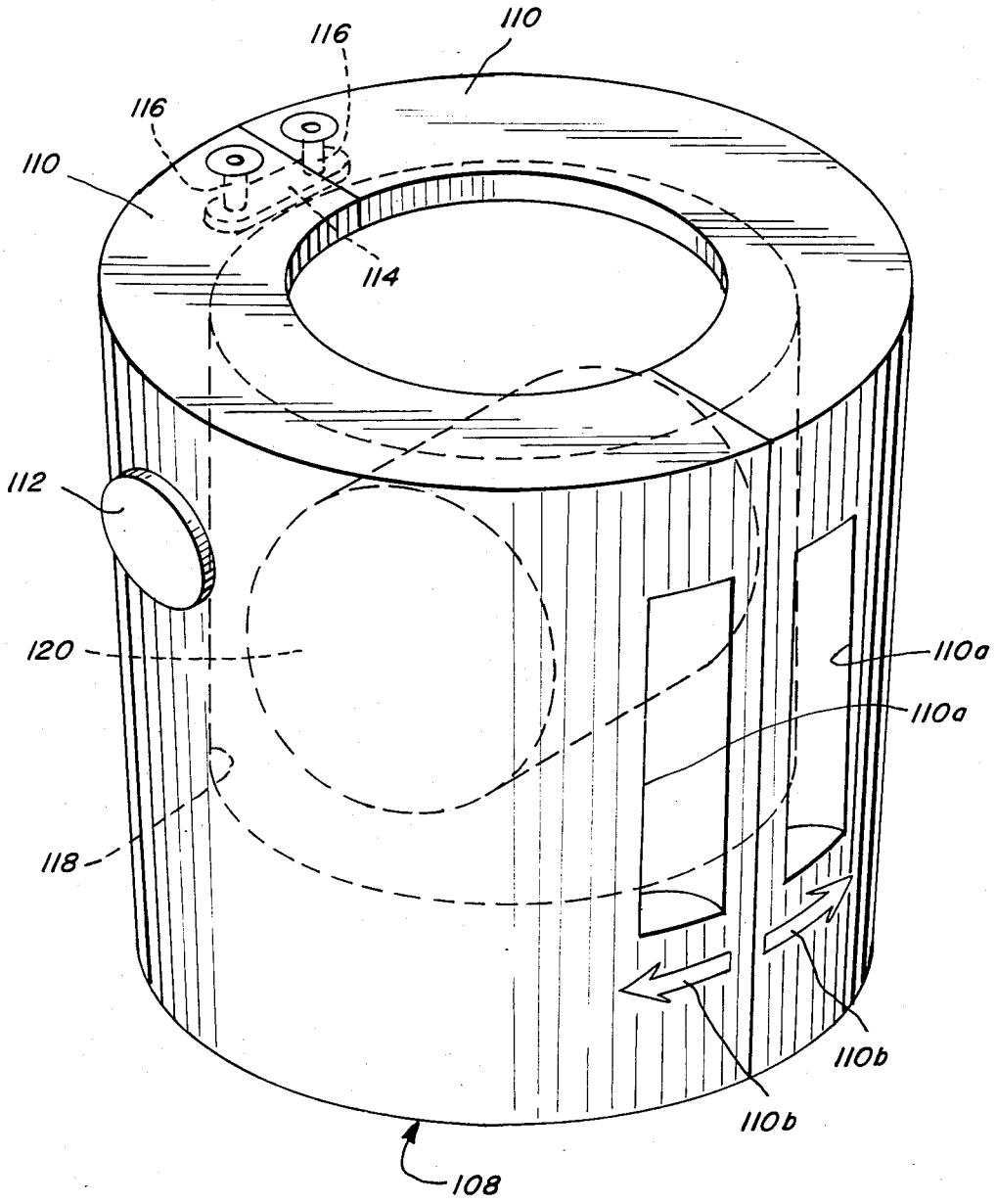
FIG. 3 is a fragmentary, vertical, cross-sectional view illustrating adapter means in accordance with the present invention for accommodating containers of different size.

In accordance with the invention, the bucket 98 is dimensioned to accommodate a can 100 of standard size such as a gallon can. However, referring now to FIG. 3, the apparatus 10 may also be provided with a cylindrically-shaped can adapter 108 adapted to accommodate smaller cans such as a quart size can. The adapter includes a pair of separate, interfitting halves 110 preferably formed of light weight urethane foam or similar material and each half is formed with an ear 112 on the outer surface adapted for driving engagement with one of the ribs 102*a* on the bucket sidewall. When a quart can is placed between the adapter halves 110 which are then closed together, the diameter and length of the can containing adapter is substantially the same as the standardized dimensions of a gallon paint can 100. The adapter halves are pivotally interconnected by pairs of pivot links 114 connected to pivot pins 116 at opposite ends and recessed into the elements 110 as shown. Diametrically opposite the pivot pins, each adapter half is provided with a finger recess 110*a* to facilitate opening the adapter. Arrows 110*b* are provided on the outer surface adjacent the finger recesses to facilitate opening up the adapter to load or unload a quart can in the cylindrical cavity 118 defined therein. The cavity is particularly dimensioned to accommodate standard size quart paint cans or the like. When utilizing the adapter 108 for quart size cans, the halves 110 are opened up by movement apart in the direction of the arrows 110*b* so that the large internal cavity 118 is exposed. A quart can is then placed inside the cavity and the halves are then pivoted back together to close and form a cylindrically shaped insert having outer dimensions similar to that of a standard size gallon paint can 100. The adapter and the quart size can contained therein are then bodily placed in the mixer bucket 98 and the motor is energized to rotate the yoke 64 and drive the bucket about their respective spin axes 44 and 74 until mixing is completed. When complete, the adapter 108 is removed from the bucket and the halves 110 opened up so that the quart size can may be removed.

It should be noted that the center of gravity of the adapter 108 and a quart can and contents placed therein, is maintained in a position identical or closely adjacent to the center of gravity 104 of a gallon can 100 and its contents placed in the bucket 98. The center of gravity 104 of the adapter and/or container and its contents is maintained continuously at a level spaced below the crossover point 76 between the two spin axes 74 and 44. The center of gravity 104 is maintained in close spaced relation to the vertical spin axis 44 and this minimizes unbalanced forces on the mechanism when the yoke 64 and elements supported thereby are rotated. The small size can adapter 108 may also be utilized to hold an even smaller sized pint can 120 which may be placed in position in the cavity 118 with the longitudinal axis of the can extending transversely to the longitudinal axis of the adapter. The generally lower weight and mass of a pint size can and contents, is readily supported in the cavity 118 without a close fit and usually the smaller pint size can 120 is maintained against the outer surface of the cavity 118 in the adapter 108 while the yoke 64 and spindle 72 are rotating.

From the foregoing, it will be seen that the paint shaker/mixer apparatus 10 of the present invention provides an extremely fast and efficient way of mixing flowable materials in closed containers and the like without requiring the containers to be clamped or otherwise positively secured in place. Placement and removal of the containers in the bucket is easy and fast and because of the relative positioning of the center of gravity of the can and its contents with respect to the crossover point between the respective intersecting spin axes, no lids or clamps are needed. The liquids and fluids contained in the cans are subjected to intense shearing action as the yoke and the bucket spindle of the apparatus are rotated simultaneously. This intense shearing action and agitation results in excellent interdispersion of liquids having differing specific gravities and evenly disperses solids in containing liquid vehicles or other solids or powders. The mixing time required is minimized and set up time for loading and unloading is greatly reduced in relation to prior art mixers.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. Apparatus for agitating flowable material such as paint and the like in a container, comprising:

bucket means having an open upper end for receiving said container of material and mounted for spinning movement about an upwardly sloping spin axis;

yoke means supporting said bucket means for spinning movement thereon, said yoke means mounted for spinning movement about a vertical spin axis angularly devergent with and intersecting said sloping spin axis of said bucket means at a crossover point; and motor means for driving said bucket means and said yoke means to simultaneously rotate about their respective spin axes;

said bucket means including means for supporting said container in spinning position on said sloping spin axis with the center of gravity of said container and contents maintained continuously spaced below said crossover point and spaced closely radially outwardly of said vertical spin axis of said yoke means, said vertical spin axis extending upwardly through said bucket means continuously during spinning movement of said yoke means in close spaced relation to the center of gravity of a container and contents placed in said bucket means, wherein said bucket means includes rib means on an inside surface of said side wall means for drivingly engaging containers placed on said bucket means.

2. The apparatus of claim 1 wherein said bucket means includes side wall means extending upwardly of said botton wall means for drivingly engaging and supporting said container in substantial coaxial alignment on said sloping spin axis.

3. The apparatus of claim 1 or 2 including spacer means removably insertable into said open upper end of said bucket means for supporting a relatively smaller sized container and contents in said bucket means with the center of gravity of said spacer means, smaller container and contents thereof spaced below said crossover point.

4. The apparatus of claim 1 wherein said spin axis of said yoke means is substantially vertically and said spin axis of said bucket means slopes downwardly and outwardly away from said crossover point toward said center of gravity of a container and contents placed in said bucket means.

5. The apparatus of claim 1 or 4 including bearing means supported on said yoke means spaced away from said spin axis thereof for supporting said bucket means for spinning movement about said sloping spin axis.

6. The apparatus of claim 5 including second bearing means supporting said yoke means for rotation about said spin axis thereof.

7. The apparatus of claim 6 including a shaft supporting said bucket means and supported by said bearing means on said yoke means, said motor means including means for rotating said yoke means and means for rotating said shaft relative to said yoke means when said yoke means is rotated.

8. The apparatus of claim 7 wherein said means for rotating said shaft includes pulley means on said shaft and fixed pulley means spaced apart therefrom concentric with said spin axis of said yoke means and endless belt means drivingly interconnecting said spaced apart pulley means.

9. The apparatus of claim 8 including idler pulley means on said yoke means spaced outwardly of said spin axis thereof for directing said endless belt between said spaced apart pulley means.

10. The apparatus of claim 1 wherein said yoke means includes a pair of arms extending laterally outwardly of said spin axis thereof, one of said arms supporting said bucket means and the other including counterweight means having a center of gravity spaced downwardly and outwardly of said crossover point on an opposite side of said yoke spin axis from said center of gravity of said container and contents in said bucket means.

11. The apparatus of claim 10 including adjustable mounting means for securing said counterweight means on said other arm at a selected position relative thereto.

12. The apparatus of claim 11 wherein said mounting means permits vertical adjustment of said counterweight means on said other arm.

13. The apparatus of claim 11 wherein said mounting means permits adjustment of said counterweight means on said other arm toward and away from said spin axis of said yoke means.

14. The apparatus of claim 10 including handle means for said other arm to facilitate manual rotation of said yoke means around said spin axis thereof.

15. The apparatus of claim 1 including a plurality of rib means spaced apart around said side wall means extending parallel of said spin axis of said bucket means.

16. The apparatus of claim 15 wherein said rib means are formed with pointed upper ends.

17. The apparatus of claim 3 wherein said spacer means is formed of low density material having a cavity centered therein for receiving and holding said smaller sized container in said bucket means with the center of gravity of said smaller sized container and contents thereof disposed substantially on said spin axis of said bucket means.

18. The apparatus of claim 17 wherein said spacer means is formed by a pair of separable elements assembled together to hold said smaller sized container in said cavity and having an outer surface shaped to fit in said bucket means.

19. The apparatus of claim 3 wherein said spacer means is formed of foamed plastic material.

* * * * *